US005675309A

United States Patent [19]

DeVolpi

[11] Patent Number: 5,675,309

[45] Date of Patent: Oct. 7, 1997

[54] CURVED DISC JOYSTICK POINTING DEVICE

[76] Inventor: Dean DeVolpi, 5722 Sparas, Loomis, Calif. 95650

[21] Appl. No.: 496,433

[22] Filed: Jun. 29, 1995

[51] Int. Cl.[6] ..... G05G 1/00

[52] U.S. Cl. ..... 338/68; 338/118; 338/128; 338/196; 338/167; 74/471 XY; 200/617

[58] Field of Search ..... 338/68, 69, 73, 338/93, 152, 128, 118, 196, 166, 167, 92, 96, 97; 340/407.2; 364/190; 200/516, 292, 6 A; 74/471 XY; 273/148 R, 148 B

[56] References Cited

U.S. PATENT DOCUMENTS

| | | | |
|---|---|---|---|
| 3,193,628 | 7/1965 | Wanlass | 338/128 |
| 3,531,754 | 9/1970 | Geese . | |
| 3,533,043 | 10/1970 | Spaude . | |
| 3,576,514 | 4/1971 | Michik . | |
| 3,629,775 | 12/1971 | Kindred . | |
| 3,652,970 | 3/1972 | Hubert . | |
| 3,900,817 | 8/1975 | Punt . | |
| 3,905,097 | 9/1975 | Beetle . | |
| 3,964,011 | 6/1976 | Ragan . | |
| 4,020,444 | 4/1977 | Oelsch et al. . | |
| 4,026,048 | 5/1977 | Hill et al. | 200/6 A |
| 4,095,210 | 6/1978 | Ragan . | |
| 4,121,188 | 10/1978 | Ragan . | |
| 4,158,831 | 6/1979 | Ragan . | |
| 4,225,845 | 9/1980 | Ragan . | |
| 4,297,671 | 10/1981 | Flanders | 338/200 |
| 4,352,084 | 9/1982 | Graves et al. | 338/127 |
| 4,361,824 | 11/1982 | Eck | 338/171 |
| 4,414,438 | 11/1983 | Maier et al. | 200/6 A |
| 4,433,217 | 2/1984 | Griffith | 200/5 R |
| 4,439,648 | 3/1984 | Reiner et al. | 200/6 A |
| 4,500,867 | 2/1985 | Ishitobi et al. | 338/128 |
| 4,511,769 | 4/1985 | Engel | 200/6 A |
| 4,533,899 | 8/1985 | Isaksson | 338/128 |
| 4,555,960 | 12/1985 | King | 74/471 XY |
| 4,590,339 | 5/1986 | Scott-Jacksone et al. | 200/6 A |
| 4,621,250 | 11/1986 | Echasseriau et al. | 338/162 |
| 4,687,200 | 8/1987 | Shirai | 200/6 A |
| 4,733,214 | 3/1988 | Andresen | 338/128 |
| 4,739,128 | 4/1988 | Grisham | 200/6 A |
| 4,748,441 | 5/1988 | Brzezinski | 340/709 |
| 4,758,692 | 7/1988 | Roeser et al. | 200/6 A |
| 4,769,517 | 9/1988 | Swinney | 200/6 A |
| 4,784,008 | 11/1988 | Paquereau et al. | 74/471 XY |
| 4,795,952 | 1/1989 | Brandstetter . | |
| 4,810,994 | 3/1989 | Froebe et al. | 338/202 |
| 4,849,583 | 7/1989 | Meyer | 200/6 A |
| 4,896,003 | 1/1990 | Hsieh | 200/6 A |
| 5,068,498 | 11/1991 | Sahakian et al. | 200/6 A |
| 5,406,040 | 4/1995 | Johnson | 200/6 A |
| 5,473,126 | 12/1995 | Wu | 225/2 |
| 5,488,206 | 1/1996 | Wu | 200/6 A |
| 5,498,843 | 3/1996 | Date et al. | 200/6 A |
| 5,510,812 | 4/1996 | O'Mara et al. | 345/161 |
| 5,515,044 | 5/1996 | Glatt | 341/22 |
| 5,541,622 | 7/1996 | Engle et al. | 345/161 |
| B1 4,355,293 | 9/1985 | Driscoll | 338/184 |

FOREIGN PATENT DOCUMENTS

| | | |
|---|---|---|
| 0 089 295 | 3/1983 | European Pat. Off. . |
| 0 286 388 | 4/1988 | European Pat. Off. . |
| 0 640 937 | 8/1994 | European Pat. Off. . |

*Primary Examiner*—Teresa J. Walberg
*Assistant Examiner*—Karl Easthom
*Attorney, Agent, or Firm*—Hill, Steadman & Simpson

[57] ABSTRACT

A low-cost joy stick or pad with improved performance, reliability and durability which can be used as a cursor pointing device for computers, remote controls, video games, consumer electronics, industrial controllers, automotive and other applications. A conductive spring or sheath connects to a conductive curved rubber transducer which can be deflected to make contact with conductors on a printed circuit board, providing electrical outputs to a microprocessor or other device.

18 Claims, 4 Drawing Sheets

CURVED DISC JOYSTICK POINTING DEVICE

BACKGROUND OF THE INVENTION

1. Field of the Invention

This invention relates in general to joystick pointing devices and in particular to an improved pointing device.

2. Description of Related Art

Joysticks are known in the art such as shown by DeVolpi U.S. Pat. Nos. 5,317,301 and 5,087,904.

SUMMARY OF THE INVENTION

It is an object of the present invention to provide an improved joystick pad pointing device that has the advantage of lower cost, higher reliability and quicker response and is smaller in size.

It is another feature of the present invention to provide an improved joystick pad pointing device that can be used for remote control for interactive devices; TV/Cable, CDI, for computer presentations and in game machines.

It is another object of the invention to provide an improved joystick-pad pointing device for wired units.

It is yet another object of the invention to provide a small joystick that can be built into a notebook or standard computer.

The present invention comprises a pointing device with at least one digital contact that radiates around the center completely or in segments with the addition of at least one analog signal which can be added for higher resolution. An external force closes one or more of the contacts which results in a movement command.

Another feature of the present invention is to provide a pointing device that is purely digital in nature that has two or more sets of digital contacts that radiate around the center of the device or are arranged in segments.

The feature of the present invention is to provide an improved joystick pad pointing device which has a reduced number of parts which results in lower costs, allows greater control at low speeds due to digital contacts, can be implemented at a very low cost and, in some cases, can be built into an existing printed circuit board. The invention has quicker response due to the use of digital direction contacts in conjunction with variable analog output. The invention provides a wakeup feature using digital contacts so as to wake up a micro controller. The invention has high reliability because it uses non-abrasive contacts and the contact is conductive rubber, plastic, or membrane switches which makes the contacts. Other objects, features and advantages of the invention will be readily apparent from the following description of certain preferred embodiments thereof taken in conjunction with the accompanying drawings although variations and modifications may be effected without departing from the spirit and scope of the novel concepts of the disclosure.

DETAILED DESCRIPTION OF THE PREFERRED EMBODIMENTS

Figure 1:
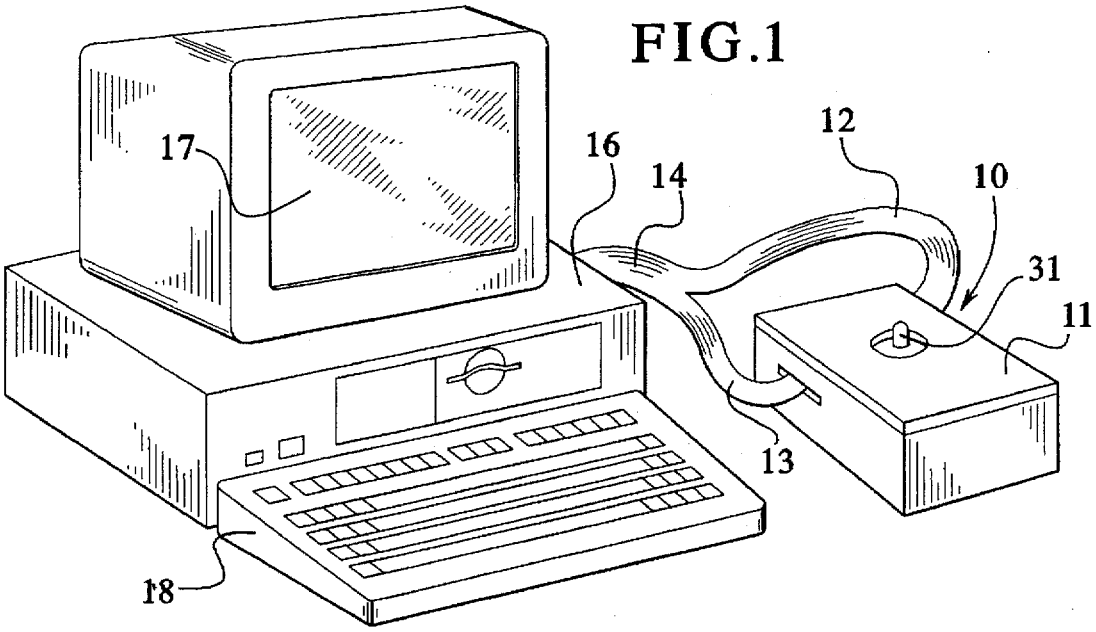
FIG. 1 is perspective view illustrating the invention connected to a computer.

The invention comprises a joystick pad pointing device which uses a board such as a printed circuit board, glass, paper, ceramic or plastics which have conductive lines and resistive coatings formed on it or embedded or otherwise provided on the surface. The board has a hole that can be plated on its inner surface and separated with laser, drilling or routing. A spring fits through the hole at a 90° angle and normally the spring does not make electrical contact with the board when external forces are absent. The spring or a sheath around the spring is electrically conductive, and the spring or sheath is biased with a voltage. When the spring or sheath is deflected by a user, it bends and makes electrical contact with the conductor within the hole. The board has electrical contacts (digital) that are closed when an external force is applied. Signals so developed are supplied to a microcontroller either or both to wake up the micro-controller and tell it the direction plus speed. Because a digital contact is used, there is not a long analog to digital conversion time. The equation is (1.1)×(resistance maximum)×(Capacitance)= maximum conversion time, which is needed by analog only joy sticks or pointing devices. In the absence of the conversion delay time by using only digital input leads allows rapid movement, which makes the present joy stick very quick to respond to the user's initial movements of the stick. The speed is determined and only limited by the speed of the micro-controller wakeup routine plus the time to send the message to the receiver. Once there is movement caused by the closure, the micro-controller then looks at the analog portion of the signal to determine how much faster to move. If the user releases the force and allows the stick to move back to the neutral position, the firmware can interpret this as a MACRO function. For example, this function can mean TAB, move to next icon, move by page or it can be the same step as normal without using macros. Upon further prolonged force/deflection, a contact is made or increased via the force diverter that causes contact on the analog/digital signal speed/direction interpreter. The micro-controller then converts this data with the earlier contact and determines various speeds and directions resulting in multiple speeds and multiple directions which are possible. The direction possibilities are at least two to infinite and speeds may be at least two to infinite. The larger the displacement of the diverter, the further out the contact is made with the analog/digital circuitry, thereby causing a variable signal which is due to the angular displacement of the spring/stick. Upon release of all the external forces by the user by letting go of the spring (stick), it moves back to its normally biased position which does not make contact with the initial digital contacts and the force diverter that is attached to the spring also moves back to the initial state. In its initial state, the force diverter can be making contact on the digital analog output section or can also not be making contact. If the force diverter is making contact in the neutral state, the microcontroller ignores this information by zeroing out this condition. The force diverter can be electrically active conductive or can be a pressure transfer point causing a variable closure on a membrane switch. The corresponding increase in force on the force diverter either increases the surface area of contact for change in resistance or it changes the absolute point of contact on the analog/digital contact thereby changing the point of the voltage potential. This changes the analog voltage. Software in the micro-controller interprets such data and sends an output to a relevant receiver which can be connected by a wire or otherwise connected.

Another novel feature of the pointing device is the "fan out" method that the circuit path traces from the resistor, thus, allowing the interleaving of the various traces for different speeds at different angles of displacement.

FIG. 1 is a perspective view illustrating the novel joystick/pressure pad of the invention mounted in a container 10 which has a top surface 11. Cables 12 and 13 extend from the container 10 and join in a cable 14 that is connected to a micro-controller 16 that is associated with a monitor 17 and a keyboard 18.

Figure 2:
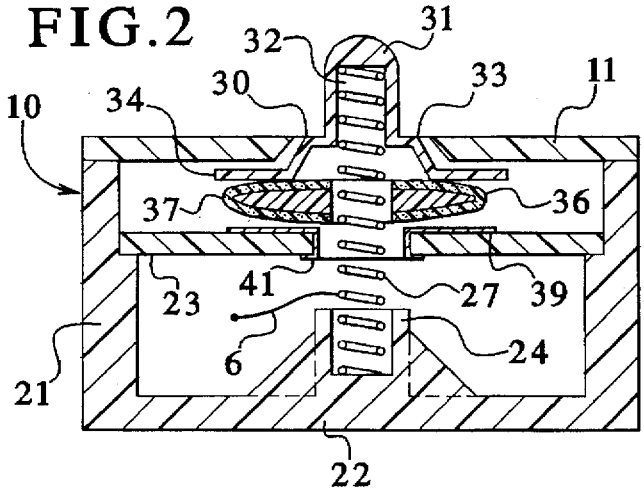
FIG. 2 is a sectional view illustrating the invention.

FIG. 2 is a sectional view of the joystick of the invention wherein the container 10 has a bottom wall 22 and side walls 21 and a top wall 11 formed with an opening 30. A spring 27 is mounted in a boss 24 formed in the bottom wall 22 and extends upwardly through an opening in a printed circuit board 23 mounted in container 10 and which has electrical conductive paths 41 and 39 formed on the inner surface of the opening and the printed circuit board. A force diverter 36 is mounted on the spring 27 and at least the outer surface is electrically conductive. It may be made, for example, of low durometer rubber and has a lower conductive surface which can engage printed circuit paths 39 on the printed circuit board 23 when the spring 27 is deflected from its center position. The spring 27 extends through the opening 30 in the top surface 11 and a stick 31 has an opening 32 in which the spring is received. The stick 31 has a downwardly extending generally conical portion 33 which joins an outer flat portion 34 that engages the force diverter 36. When the stick 31 is moved, it causes the spring 27 to be deflected so it engages the surface of the conductors 41 formed in the opening in the printed circuit board 23 and also causes the force diverter 36 to engage the printed circuit paths 39 on the printed circuit 23. The container 10 may be made of non-conductive material and an electrical voltage is applied to spring 27 by a conductor 6 so as to provide an energizing voltage.

Figure 3:
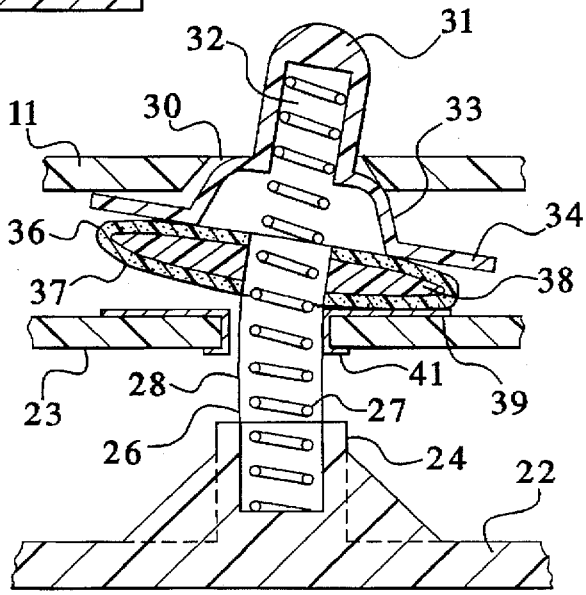
FIG. 3 is a sectional view illustrating the invention.

FIG. 3 illustrates the joystick 31 in a deflected from neutral position wherein the outer conductive surface 37 of the force diverter 36 engages the printed circuit conductors 39 and a sheath 28 which is electrically connected to the spring 27 makes electrical contact with one of the conductors 41 in the opening in the printed circuit board. The center of the force diverter 36 may be hollow or filled with a suitable filler such as plastic 38.

Figure 4:
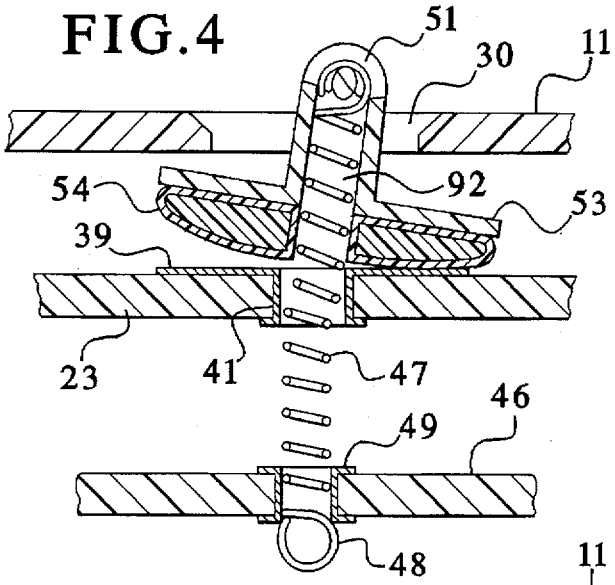
FIG. 4 is a sectional view illustrating a modification of the invention.

FIG. 4 illustrates a slightly modified form of the invention wherein the spring 47 has a first end 48 that is mounted by a sleeve 49 in a bottom plate 46 of the container 10, and the upper end of the spring 47 is received in the hollow insides 92 of a stick 51 which attaches to a bottom plate 53 which engages the force diverter 54. The spring 47 fits in the opening 92 in the stick 51. By moving the stick 51, the force diverter 54 will engage the conductive paths 39 on the printed circuit board 23, and the spring 47 will engage the conductive paths 41 on the inside of the opening in the printed circuit board 23.

Figure 5:
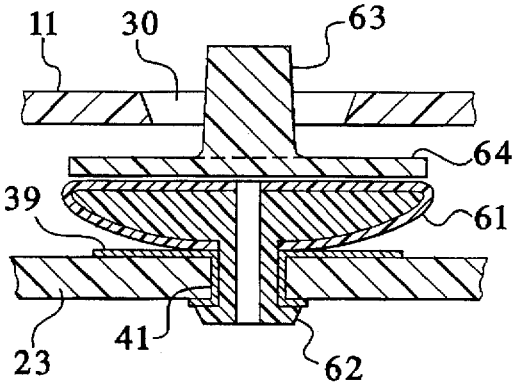
FIG. 5 illustrates a modification of the invention.

FIG. 5 illustrates a further modification of the invention wherein the force diverter 61 may be made of a flexible substance such as low durameter rubber and has a portion which extends through an opening in the printed circuit board and terminates in an enlarged portion 62. A stick 63 extends through the opening 30 in the top cover 11 and has a lower flat portion 64 which engages the force diverter 61 to move it to engage the circuit paths 39 on the printed circuit board 23.

Figure 6:
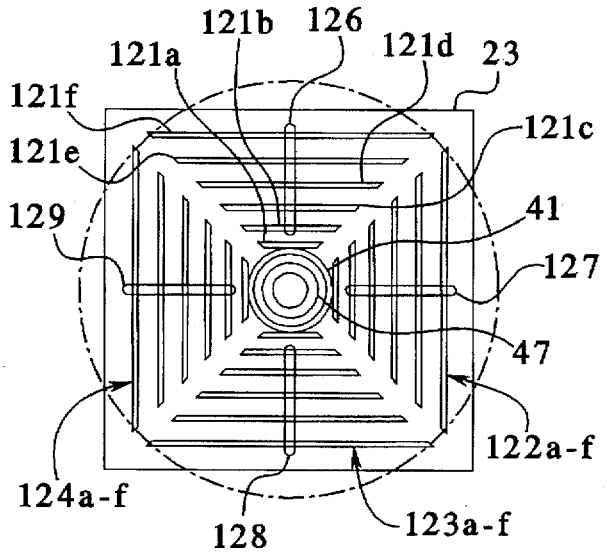
FIG. 6 is a plan view of the circuit board and the resistors and conductive paths thereon.

FIG. 6 illustrates in plan view the circuit board 23 and includes a first plurality of parallel conductors **121*a* through 121*f* mounted on a first segment portion of the board. A resistive path 126 extends at right angles to the conductors 121 and makes electrical contact therewith. A second plurality of electrical conductors are formed in another segment of the printed circuit board 123*a* through 123*f* and are designated 122*a* through 122*f* and a resistive path 127 extends at right angles to the conductors 122*a* through f and makes electrical contact therewith. A third plurality of conductors 123*a* through 123*f* are also mounted on the board in a different segment and are electrically connected to a resistive path 128 which extends at right angles thereto. A fourth plurality of conductors 124*a* through 124*f* are mounted on another segment of the board 23 and are connected to a resistive path 129 which extends at right angles thereto. The spring 47 when deflected engages the conductors 41 on the inside of the opening, and the force diverter 54** engages the printed circuit board.

Figure 7:
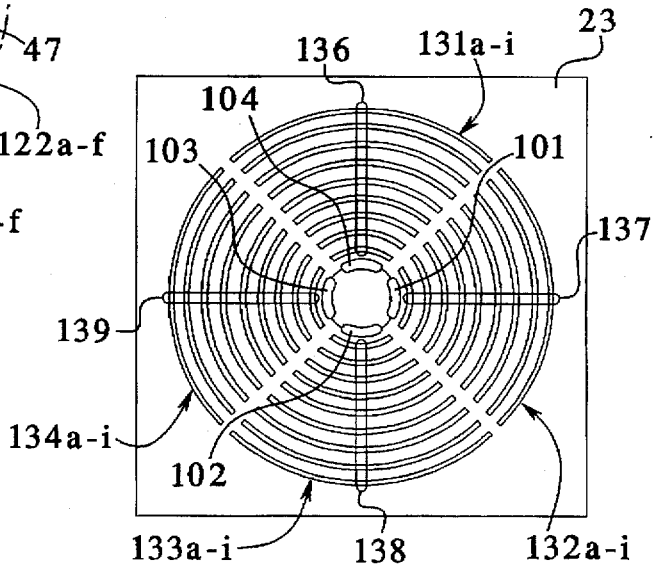
FIG. 7 illustrates a modified form of the circuit board.

FIG. 7 illustrates another arrangement of the printed circuit board 23 wherein a first plurality of printed circuit paths in the form of segments of a circle **131*a*–131*i* are formed in a first segment and are traversed by resistive path 136. A second plurality of curved segments 132*a*–132*i* are formed on the printed circuit board and are traversed by a resistive path 137. A third plurality of curved segments conducted paths 133*a*–133*i* are formed on the board and are traversed by resistive path 138. A fourth plurality of curved segments 134*a*–134*i* are mounted on another segment of the printed circuit board 23 and are traversed by resistive path 139. The opening through the printed circuit board is formed with four separate conductive paths 101, 102, 103 and 104** which are separated from each other as shown.

Figure 8:
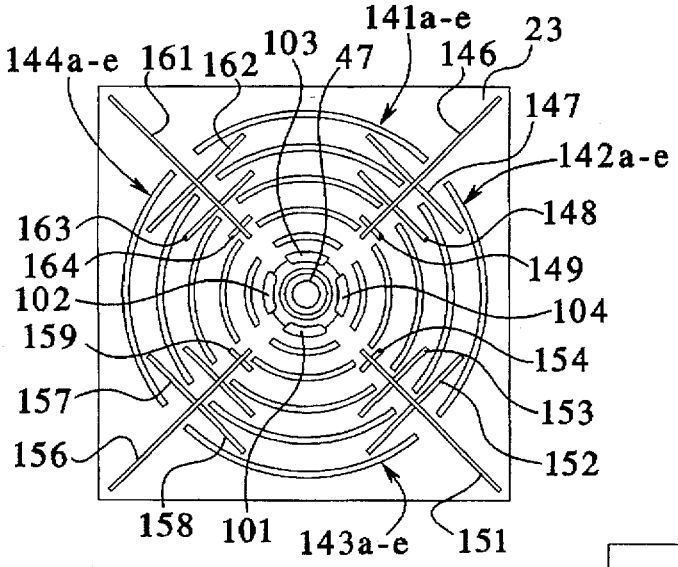
FIG. 8 illustrates a modified form of the circuit board.

FIG. 8 is a modification of the circuit board of FIG. 7 wherein a radially extending printed circuit path 146 is mounted in the space between a first plurality of curved segments **141*a*–141*e* and a second plurality of curved segments 142*a*–142*e*. Circuit paths 147, 148 and 149 extend from the radial circuit path 146 between the curved segments 141 and 142** as shown.

Other radial circuit paths 151, 156 and 161 extend through the gaps between the curved conductive paths **142*a*-3 and 144*a*-3 as shown. Radial circuit path 151 has transverse extending conductive paths 152, 153 and 154 as shown. Radial circuit path 156 has transverse extending circuit paths 157, 158 and 159 as shown. Radial circuit path 161 has extending transverse circuit paths 162, 163 and 164 as shown. The spring 47 is engageable with the conductive segments 101, 102, 103 and 104** when deflected.

Figure 9:
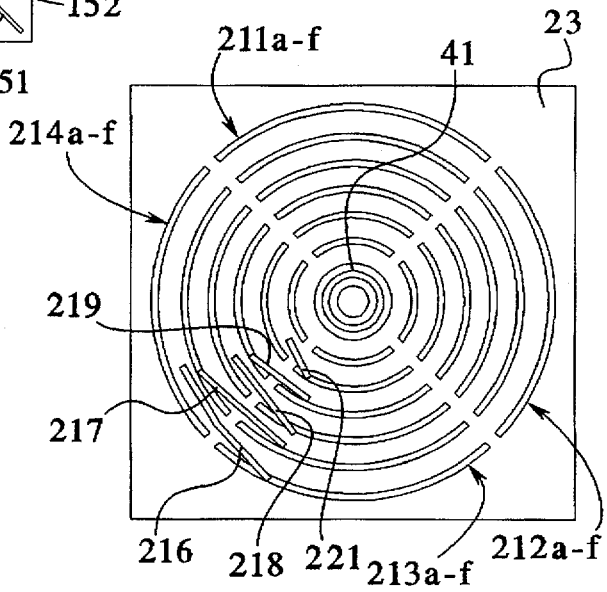
FIG. 9 illustrates a modified form of the circuit board.

FIG. 9 shows another modification of the invention wherein circuit paths 216, 217, 218 and 219 are interwoven between the curved circuit paths such as **213*a*–213*f* and 214*a*–214*f* and extend at angles which are not perpendicular to radials so as to increase the quantity of speeds that are available in diagonals. It is to be realized, of course, that the interwoven fingers such as 216–219 would also be formed between the segments 212*a*–212*f* and 213*a*–213*f* as well as between the segments 211***a*–211*f* and 212*a*–212*f* and also between the segments 211*a*–211*f* and 214*a*–214*f*.

Figure 10:
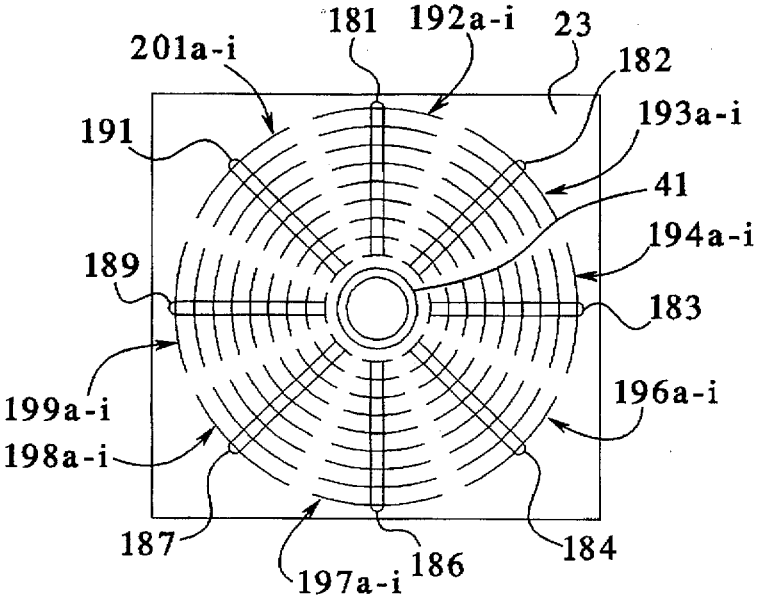
FIG. 10 illustrates a modified form of the circuit board.
Figure 12:
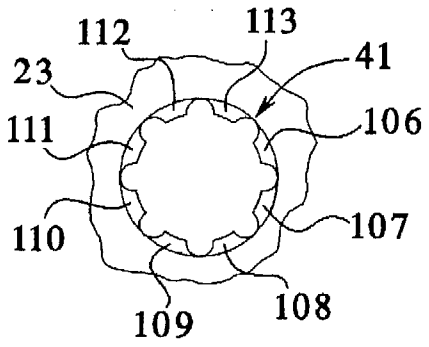
FIG. 12 illustrates a modification of the center contacts.
Figure 11:
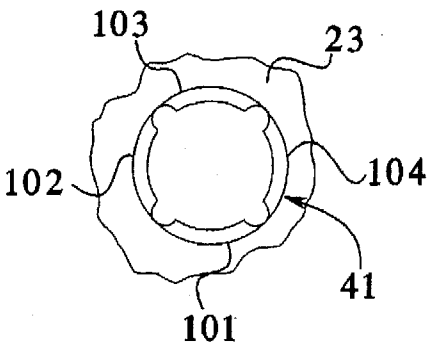
FIG. 11 is a plan view of the center contacts.

FIG. 10 illustrates a printed circuit board 23 which is formed with additional separated curved segments so as to increase the angular resolution of the device. First parallel curved segments 192*a*–192*i* are traversed by resistive path 181. Second segments 193*a*–193*i* are traversed by resistive path 182. A third plurality of segments 194*a*–194*i* are traversed by resistive path 183. A fourth plurality of segments 196*a*–196*i* are traversed by resistive path 184. A fifth plurality of radial segments 197*a*–197*i* are traversed by resistive path 186. A sixth plurality of radial segments 198*a*–198*i* are traversed by a resistive path 187. A seventh plurality of conductive paths 199*a*–199*i* are traversed by a resistive path 189 and an eighth plurality of conductive paths 201*a*–201*i* are traversed by resistive path 191 as shown. This increases the angular resolution of the device by a factor of two over the board shown in FIGS. 6 and 7 for example.

Figure 13:
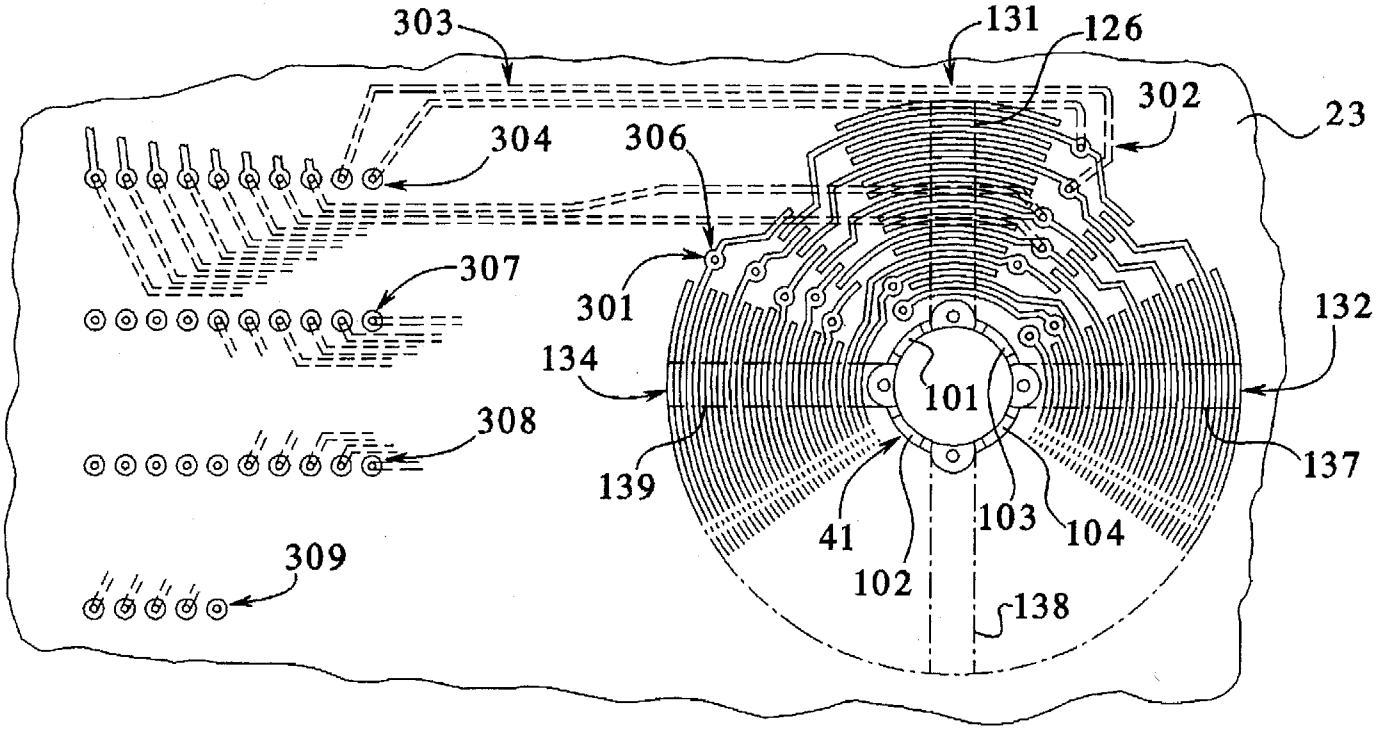
FIG. 13 is a detailed view of the electrical paths on the printed circuit board.

FIG. 13 illustrates in detail the manner of connecting the various electrical conductive paths to an external circuit. The conductive portions 101, 102 and 103 and 104 formed in the opening of the printed circuit board 23 are connected to terminals as shown which are then connected by conductive paths to terminals such as 309. Curved segments 131 are each connected to different terminals and are connected by leads such as 302 and 303 to different terminals 304. Other segments are each connected to different terminals such as 306 which are connected to different remote terminals 304 by conductive path 5.

Thus, the present invention provides a novel joystick which allows many different orientations to be recognized and sent to a control device, as well as allows the amount of deflection of the joystick or pressure pad to be detected, so as to provide a control signal.

Although the invention has been described with respect to preferred embodiments, it is not to be so limited as changes and modifications can be made which are within the full intended scope of the invention as defined by the appended claims.

I claim as my invention:

1. A joystick pointing device comprising:

a substrate formed with a hole defined by a fixed pivoting area wherein a surface of said substrate is coated with electrically conductive material;

an electrically conductive force disc that makes electrical contact on said substrate at various positions; and a pivoting mechanism having a flexible pivoting portion extending through said hole of said substrate wherein said force disc is attached to said pivoting mechanism above said pivoting area and further wherein said pivoting mechanism has an undeflected position and is movable to a deflected position by flexibly pivoting about said pivoting area wherein said pivoting mechanism causes said force disc to change electrical contact position with said electrically conductive material on said surface of said substrate to cause a corresponding change in signal output when said electrically conductive disc changes electrical contact position.

2. The joystick pointing device according to claim 1 wherein said pivoting mechanism is electrically conductive.

3. The joystick pointing device according to claim 2 wherein a voltage is applied to said pivoting mechanism.

4. The joystick pointing device according to claim 1 wherein said electrically conductive material on a surface of said substrate includes electrically conductive material within said pivoting area formed as a plurality of angularly displaced conductive portions such that when said pivoting mechanism is deflected it engages at least one of said plurality of angularly displaced portions.

5. The joystick pointing device according to claim 1 wherein said pivoting mechanism is a spring.

6. The joystick pointing device according to claim 5 further comprising;

an electrical conducting sheath which fits around said spring.

7. The joystick pointing device according to claim 5 further comprising:

a housing which supports said substrate and one end of said spring.

8. The joystick pointing device according to claim 5 wherein said force disc is mounted on said spring which is movable to selectively engage selected ones of said plurality of electrical conductive paths when said spring is deflected.

9. The joystick pointing device according to claim 8 wherein said plurality of electrical conductive paths are formed as arcuately shaped segments about said pivoting area.

10. The joystick pointing device according to claim 8 wherein said plurality of electrical conductive paths are formed of straight segments.

11. The joystick pointing device according to claim 10 wherein said resistive material includes:

a plurality of radially extending resistors formed on said substrate about said pivoting point wherein each of said resistors are electrically connected to different groups of said straight segments.

12. The joystick pointing device according to claim 8 wherein said plurality of electrical conductive paths are formed of straight segments.

13. The joystick pointing device according to claim 8 wherein the upper surface of said force disc is substantially planar.

14. The joystick pointing device according to claim 1 wherein said force disc is formed of a flexible material.

15. A joystick pointing device comprising:

a substrate formed with a hole defined by a fixed pivoting area wherein a surface of said substrate is coated with electrically conductive material;

an electrically conductive force disc that makes electrical contact on said substrate at various positions;

a pivoting mechanism which is a spring having an electrical conducting sheath which fits around said spring; and said pivoting mechanism extending through said pivot hole of said substrate wherein said force disc is attached to said pivoting mechanism above said proofing area and further wherein said pivoting mechanism has an undeflected positon and is movable to a deflected position by flexibly pivoting about said pivoting area and still further wherein said pivoting mechanism causes said force disc to change electrical contact position with said electrically conductive material on said surface of said substrate to cause a corresponding change in signal output when said electrically conductive force disc changes electrical position wherein said electrically conductive material comprises a plurality of angularly displaced electrical conductive paths formed on a planar surface of said substrate about said pivoting area and a resistive material formed on said planar surface about said pivoting area wherein portions of said resistive material are electrically connected to said conductive paths.

16. A joystick pointing device comprising:

a substrate formed with a hole defined by a fixed pivoting area wherein a surface of said substrate is coated with electrically conductive material;

an electrically conductive force disc that makes electrical contact on said substrate at various positions; and a pivoting mechanism comprising a spring extending through said hole of said substrate wherein said force disc is attached to said pivoting mechanism above said pivoting area and further wherein said pivoting mechanism has an undeflected position and is movable to a deflected position by flexibly pivoting about said pivoting area wherein said pivoting mechanism causes said force disc to change electrical contact position with said electrically conductive material on said surface of said substrate to cause a corresponding change in signal output when said force disc changes electrical contact position and still further wherein a plurality of electrical conductive paths are formed on a planar surface of said substrate about said pivoting area, and said force disc is mounted on a said spring which is movable to selectively engage selected ones of a said plurality of electrical conductive paths when said spring is deflected, said plurality of electrical conductive paths are formed as arcuately shaped segments about said pivoting point and are formed on a planar surface of said substrate about said pivoting area wherein said electrically said conductive material comprises a second plurality of angularly displaced electrical conductive paths formed on a planar surface of said substrate about said pivoting area and a resistive material formed on said planar surface about said pivoting area wherein portions of said resistive material are electrically connected to said second plurality of conductive paths.

17. A joystick pointing device comprising:

a substrate formed with a hole defined by a fixed pivoting area wherein a surface of said substrate is coated with electrically conductive material;

an electrically conductive force disc that makes electrical contact on said substrate at various positions; and a pivoting mechanism comprising a spring extending through said hole of said substrate wherein said force disc is attached to said pivoting mechanism above said pivoting area and further wherein said pivoting mechanism has an undeflected position and is movable to a deflected position by flexibly pivoting about said pivoting area wherein said pivoting mechanism causes said force disc to change electrical contact position with said electrically conductive material on said surface of said substrate to cause a corresponding change in signal output when said force disc changes electrical contact position and still further wherein a plurality of electrical conductive paths are formed on a planar surface of said substrate about said pivoting area, and said force disc is mounted on said spring which is movable to selectively engage selected ones of said plurality of electrical conductive paths when said spring is deflected, said plurality of electrical conductive paths are formed of straight segments and having a plurality of radially extending resistors formed on said substrate about said pivotng area wherein each of said resistors are electrically connected to different groups of said straight segments.

18. A joystick pointing device comprising:

a substrate formed with a fixed hole defined by a pivoting area wherein a surface of said substrate is coated with electrically conductive material;

an electrically conductive force disc that makes electrical contact on said substrate at various positions; and a pivoting mechanism comprising a spring extending through said hole of said substrate wherein said force disc is attached to said pivoting mechanism above said pivoting area and further wherein said pivoting mechanism has an undeflected position and is movable to a deflected position by flexibly pivoting about said pivoting area wherein said pivoting mechanism causes said force disc to change electrical contact position with said electrically conductive material on said surface of said substrate to cause a corresponding change in signal output when said force disc changes electrical contact position and still further wherein a plurality of electrical conductive paths are formed on a planar surface of said substrate about said pivoting area, and said force disc is mounted on a said spring which is movable to selectively engage selected ones of said plurality of electrical conductive paths when said spring is deflected wherein said plurality of electrical conductive paths are formed of straight segments wherein said electrically conductive material comprises a plurality of angularly displaced electrical conductive paths formed on a planar surface of said substrate about said pivoting area and resistive material formed on said planar surface about said pivoting area wherein portions of said resistive material are electrically connected to said conductive paths.

* * * * *